United States Patent [19]

Kharadly Mostafa Z. et al.

[11] Patent Number: 4,940,990

[45] Date of Patent: Jul. 10, 1990

[54] INTRABUILDING WIRELESS COMMUNICATION SYSTEM

[75] Inventors: Kharadly Mostafa Z., Vancouver; Fredrick W. C. Siu, Burnaby, both of Canada

[73] Assignee: University of British Columbia

[21] Appl. No.: 298,753

[22] Filed: Jan. 19, 1989

[51] Int. Cl.[5] ..... H01Q 21/00; H01Q 13/00

[52] U.S. Cl. ..... 343/773; 343/785; 343/893

[58] Field of Search ..... 343/720, 725, 772, 773, 343/776, 785, 786, 893; 455/53, 54, 55, 66; 340/870.28, 870.25, 870.26

[56] References Cited

U.S. PATENT DOCUMENTS

| | | | |
|---|---|---|---|
| 3,829,863 | 8/1974 | Lipsky | 343/773 |
| 4,143,377 | 3/1979 | Salvat et al. | 343/773 |
| 4,349,826 | 9/1982 | Lucanera | 343/773 |
| 4,468,672 | 8/1984 | Dragone | 343/785 |
| 4,575,727 | 3/1986 | Stern et al. | 343/785 |
| 4,673,947 | 6/1987 | Newham | 343/785 |
| 4,783,665 | 11/1988 | Lier et al. | 343/785 |

FOREIGN PATENT DOCUMENTS

| | | | |
|---|---|---|---|
| 1910995 | 9/1970 | Fed. Rep. of Germany | 343/785 |
| 55-47743 | 4/1980 | Japan | 455/55 |

OTHER PUBLICATIONS

W. L. Barrow, et al. Biconical Electromagnetic Thorns Proceedings of the I.R.E. vol. 27, No. 12, Dec. 1939.

Wireless Communications for Office Information Networks—Pahlavan—IEEE Communications Magazine, vol. 23 No. 6, Jun. 1985.

Horizontally Polarized Biconical Horn Antenna Using Metal Plate Lens—Uenakada—Electronics and Communications in Japan, vol. 59-B No. 7, 1976.

Dielectric Tapered Rod Antennas for Millimeter-Wave Applications—Kobayashi et al.—IEEE Transactions on Antennas and Propagation, vol. AP-30, No. 1, Jan. 1981.

Cordless Communication within Buildings: results of measurements at 900 MHz and 60 GHz—Alexander et al.—Br Telecom Technol J, vol. 1, Jul. 1983.

*Primary Examiner*—Rolf Hille

*Assistant Examiner*—Peter Toby Brown

*Attorney, Agent, or Firm*—C. A. Rowley

[57] ABSTRACT

An intrabuilding wireless communication system is disclosed wherein a work space is divided into a radiation zone seldom entered or occupied by workers and into which the signal carrying radiation is directed and contained i.e. the space adjacent to the ceiling and extending down about 1 meter and a substantially radiation free zone that is normally occupied by workers. A master node antennae and each of the subscriber antennae (one for each work station in the work space) are located within the radiation space.

The master antennae will preferably be an omni-directional antennae formed by a pair of substantially mirror image frusta-conical disks, axially aligned along their conical axes and with their minimum radius end faces in spaced parallel facing relationship. An axially extending probe through one of the disks and terminating at one end as an antennae in a space between the minimum radius end faces and at its opposite end as another antennae in a waveguide delivering and conveying energy to and from the master antennae.

8 Claims, 5 Drawing Sheets

INTRABUILDING WIRELESS COMMUNICATION SYSTEM

FIELD OF THE INVENTION

The present invention relates to an intrabuilding wireless communication system. More particularly the present invention relates to a an extremely high frequency multiple access communication system with reduced radiation hazards, a special omni-directional antenna a master or node antenna and a special type dielectric rectangular rod antenna as a subscriber antenna.

BACKGROUND TO THE PRESENT INVENTION

The concept of using extremely high frequency of about 60 GHz has been proposed and some of the characteristics thereof have been investigated as described in "Cordless Communication within Buildings: results of measurements at 900 MHz and 60 GHz" by Alexander and Pugliese, Br Telecom Technol J, Vol 1, July 1983, pages 99 to 105. This paper describes a proposed system for using extremely high frequency radio transmission within a building and examines the fading characteristics when employing a particular type of omnidirectional aerial modeled on the design of Uenakada et al, "Horizontally polarized biconical horn antenna and metal plate lens," Electronics and Communications in Japan, 59-B, No 7, pp 80 (1976). In this system the energy is coupled to the antenna in a circular wave guide carrying in the $TE_{01}$ mode. The resulting radiation is "horizontally" polarized.

In the arrangement used by Alexander et al the central and the subscriber or work station antennae are essentially the same. The concept is to totally flood the whole work space and to use these antennae structures to transmit and receive data between the central or main computer and each of the work or subscriber stations.

It has also been suggested to combine spread spectrum techniques with the use of radio frequency for intraoffice communication, see Pahlavana "Wireless communication for office information networks" IEEE Communications Magazine, Vol 23, June 1985.

BRIEF DESCRIPTION OF THE PRESENT INVENTION

It is an object of the present invention to provide an intrabuilding wireless communication system adapted to reduce radiation hazards in the work place and permit operation using frequencies in the extremely high frequency range.

It is also an object of the present invention to provide a new antennae system namely a specific node antenna and/or an improved dielectric rectangular rod antenna.

Broadly, the present invention relates to an intrabuilding wireless multi-access communication system for use within a work space comprising, a primary antenna system transmitting coded signals and supplying radiation substantially only within a first zone occupying only a portion of said work space, a second zone substantially free of radiation and occupying substantially the remainder of said work space, said first zone being positioned adjacent to an upper boundary of said work space, work stations within said second zone, each of said work stations having a secondary antenna system connected thereto, each said secondary antenna system having an antenna positioned within said first zone and oriented relative to said primary antenna to receive and transmit signals between said primary and said secondary antennae.

Preferably said secondary antennae will transmit radiation and coded signals substantially only within said first zone.

Preferably said first zone will be spaced from a floor of said work space by about 2 meters to provide a radiation free zone substantially equivalent in height to the height of workers working in said work space.

The primary antenna will preferably be a node antenna and will comprise a pair of substantially mirror image frusta-conical disks having their conical axes in axial alignment and with their minor diameter ends in space substantially parallel facing relationship to provide a gap therebetween, a wave guide for delivering energy to and from said antenna and an axially extending probe along said conical axis of one of said disks, said probe terminating at one end in a first antenna structure located within said gap and at its opposite end in a second antenna structure located within said waveguide, whereby said probe conveys energy between said waveguide and said gap.

The longitudinal axis of said waveguide is perpendicular to said conical axes and preferably will be radial relative to said conical axes.

Preferably the secondary antenna for each said work station will comprise a special type of dielectric rectangular rod antenna including a waveguide and a flared dielectric element extending from said waveguide, said dielectric element having two pairs of opposed planar sides, at least one of said pairs of opposed sides having sides diverging from each other at an included angle symmetric with the longitudinal axis of said waveguide from which said dielectric element extends.

Preferably said included angle will be about 10 degrees.

BRIEF DESCRIPTION OF THE DRAWINGS

Further features, objects and advantages will be evident from the following detailed description of the present invention taken in conjunction with the accompanying drawings in which.

DESCRIPTION OF THE PREFERRED EMBODIMENTS

Figure 1:
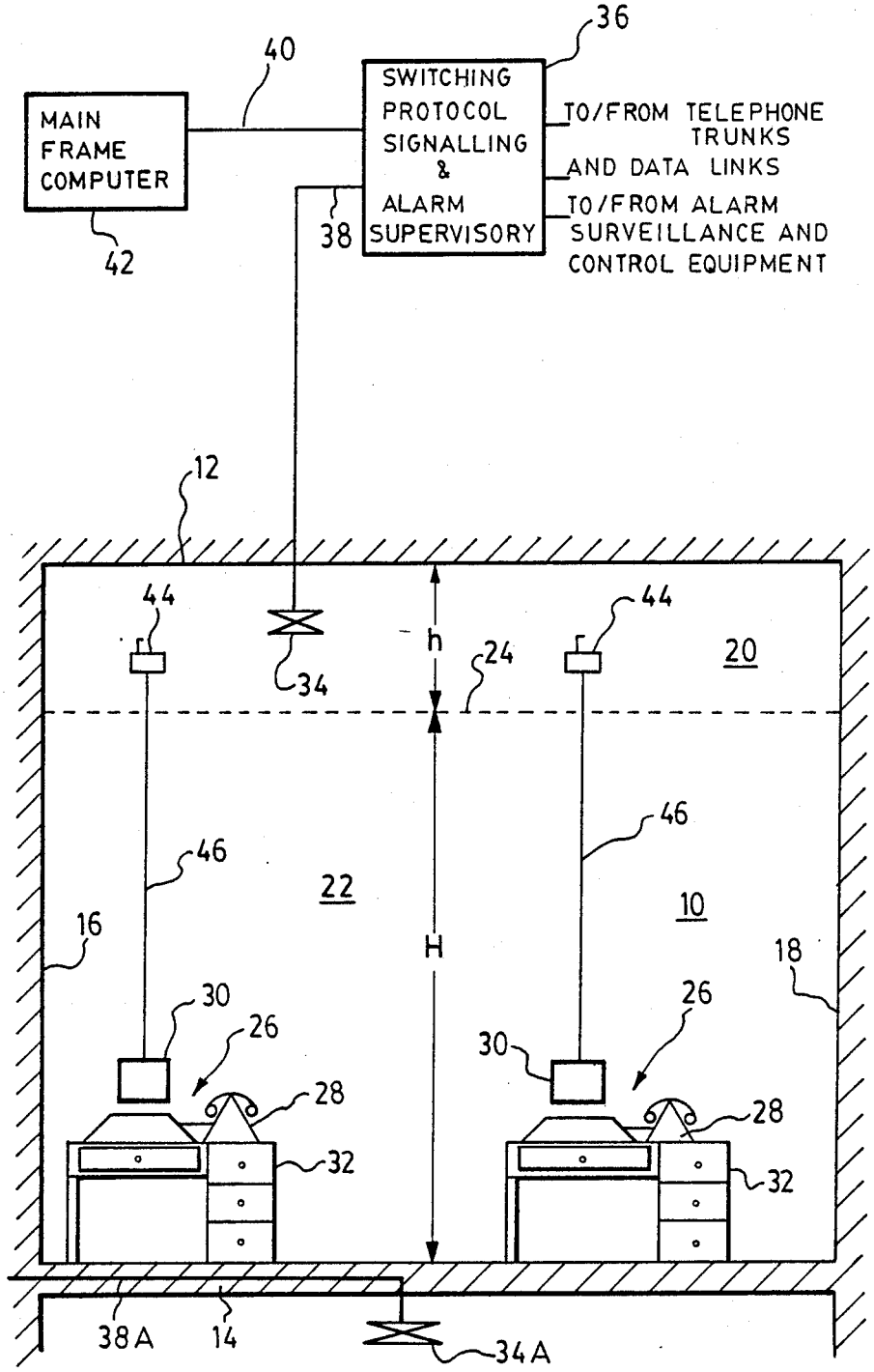
FIG. 1 is a side elevation schematically illustrating a work space and the accompanying equipment for practicing the present invention.

As shown in FIG. 1 a work space 10 is bounded by a ceiling 12 floor 14 and side walls 16 and 18 and end walls (not indicated). The work space 10 is composed of a first zone 20 and a second zone 22. The first zone 20 (radiation zone) extends from the ceiling 12 down toward the floor 14 a distance h which normally will be about h=1meter. The transmission energy for the communication system from each of the antennae is all directed into the first zone will be described hereinbelow so that the whole upper volume of the work space 10 forms a radiation zone 20.

The second zone 22 is located below the zone 20 i.e. between the zone 20 and the floor 14. This second zone 22 is substantially free of radiation from the antenna of the invention and is designated as a radiation free zone 22. The two zones 20 and 22 meet at a border 24 which preferably will be substantially horizontal i.e. parallel to and positioned between the ceiling 12 and floor 14. Obviously, the border 24 will not be planar as shown but will be roughly as indicated.

The spacing of the border 24 from the floor 14 or height H of the second (radiation free) zone will generally be about H=2 meters so that humans occupying the work space and standing on the floor 14 will not project to any substantial extent into the first (radiation) zone 20.

Contained within the work space 10 are a plurality of work stations 26. In the illustrated arrangement, two such work stations have been shown, but normally there will be many more such stations in each work space. Each work station will generally include electronic working equipment such as a telephone or the like 28 and a computer such as a personal computer or terminal 30 supported on a suitable structure such as a desk 32.

Contained within the radiation zone 20 is an omnidirectional main node antenna 34 which is connected via line 38 to a suitable computer switching arrangement 36 containing the switching protocol for connecting with other systems such as alarms and data link and/or via line 40 with the main frame computer 42.

Also contained within the first (radiation) zone 20 are discrete subscriber or work station antenna systems 44, each of which is connected to its respective work station 26 via a connecter 46. The antenna systems 44 may be suspended from the top of the work space i.e. in the first zone 20 by any suitable means. In the illustrated arrangement, each of the connecters 46 also function as a mast to position the system 44 in the zone 20. Alternatively the antenna systems 44 could simply be hung from the ceiling 12 and be interconnected by a suitable connecting wire 46 with their respective work station.

It will be apparent that the work stations 26 may be moved from place to place within the work space 10 and no rewiring of the communication system is necessary (obviously, electric power will still have to be supplied in the new location.) provided the antenna system for the moved work station remains within the zone 20.

As illustrated in FIG. 1 a second system may be installed in adjacent floors as indicated by the node antenna 34A positioned beneath the floor 14 of the work space 10 and this antenna 34A connected to the appropriate other equipment via the line 38A to provide a second independent system on another floor or another work space on the same floor.

The node antenna 34 and the work station or subscriber antenna systems will operate using two separate frequencies. In the illustrated system shown in FIGS. 2 and 3, the omni-directional node antenna 34 receives on frequency $f_1$ and transmits on frequency $f_2$ while the systems 44 receive on frequency $f_2$ and transmit on frequency $f_1$. Frequencies $f_1$ and $f_2$ while significantly different need not in absolute frequencies have a wide difference therebetween. For example, frequency $f_1$ might be about $f_1=56$ GHz and frequency $f_2=52$ GHz. It is preferred to operate with a carrier frequency at about 60 GHz but other frequencies may be used. It is important for miniaturization that the frequency be very high so that the wave length is correspondingly short and the antenna structures used may be very small. The 60 GHz range of frequency is also important for containment of the signals within the confines of the building or work space.

The node antenna 34 and or the antennae for the antenna systems 44 may be any suitable antennae, however a preferred antenna structure for each application will be described in more detail hereinbelow. .

Figure 2:
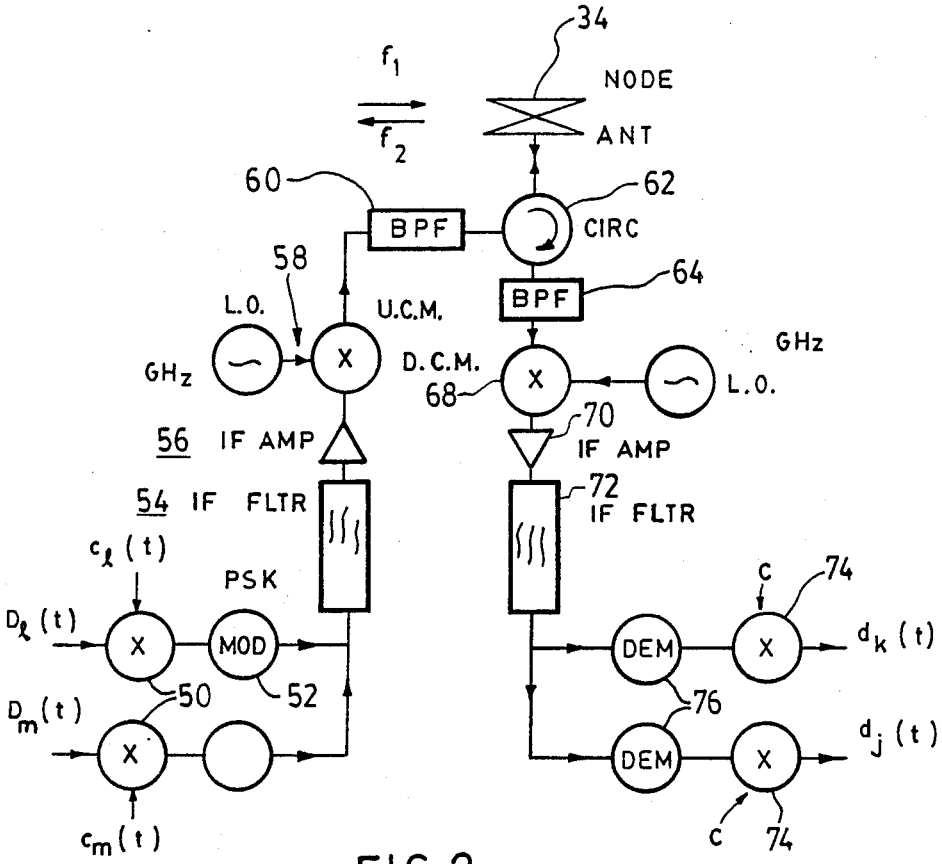
FIG. 2 is a schematic example of one form of circuitry that may be used to operate the main node antenna of the present invention.

The transmitting and receiving system shown for the node antenna 34 illustrated in FIG. 2 provides one suitable arrangement. Each data stream (D) to be transmitted (originating from the various sources) is coded via suitable coders 50 and then modulated as indicated at 52 using a phase shift key modulator. The data stream is then passed through an intermediate frequency filter 54 and the filtered signal is amplified in an intermediate frequency amplifier 56 and up-converted to carrier frequency $f_2$ as indicated at 58. Next, the combined signal is passed through a band-pass filter 60 and then through the circulator 62 to the node antenna 34 for transmission.

The received signal passes from the node antenna 34 to the circulator 62 then to a second band-pass filter 64 and a down conversion mixer 68 to convert the $f_1$ carrier frequency to an intermediate frequency IF. The IF signal is then amplified in an intermediate frequency amplifier 70, filtered in an intermediate frequency filter 72, demodulated in the phase shift demodulator 76 and then decoded in a decoder 74. This signal is then transferred by a suitable conductor 38 to the control centre 36 (see FIG. 1) for transmission to the appropriate equipment.

Figure 3:
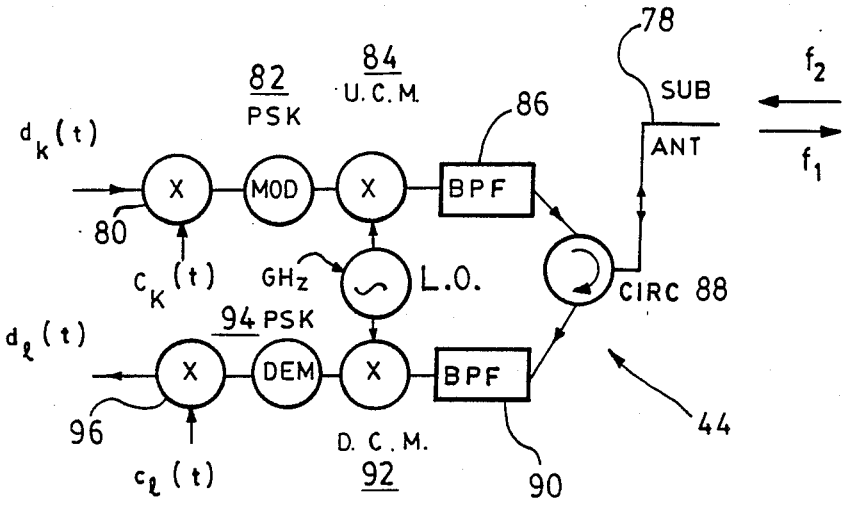
FIG. 3 is a schematic representation of a transmitting and receiving system for a typical work or subscriber station.

Each of the antenna systems 44 will comprise a system such as that illustrated in FIG. 3 and will include a suitable subscriber antenna 78, the preferred form of which will be described hereinbelow. The transmitted signal from the work station 26, indicated at $d_k$, is coded by the coder 80, modulated by the phase shift keying modulator 82, up converted to carrier frequency $f_1$ as indicated at 84, filtered in a band pass filter 86 and fed to the circulator 88 and antenna 78.

The received signal on the other hand passes from the circulator 88 to a band pass filter 90 and is down converted to an intermediate frequency IF as indicated at 92. The IF signal passes from the down conversion mixer 92 to a phase shift key demodulator 94 and decoder 96 and then to the work station 26 via the connection 46 (see FIG. 1.)

Figure 4:
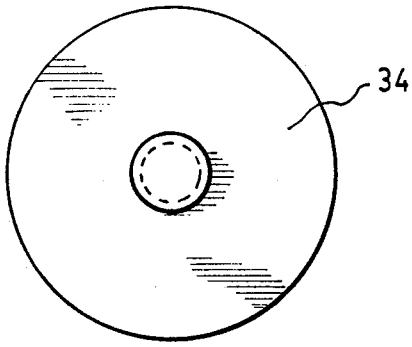
FIG. 4 is a plan view of a node antenna constructed in accordance with the present invention.
Figure 5:
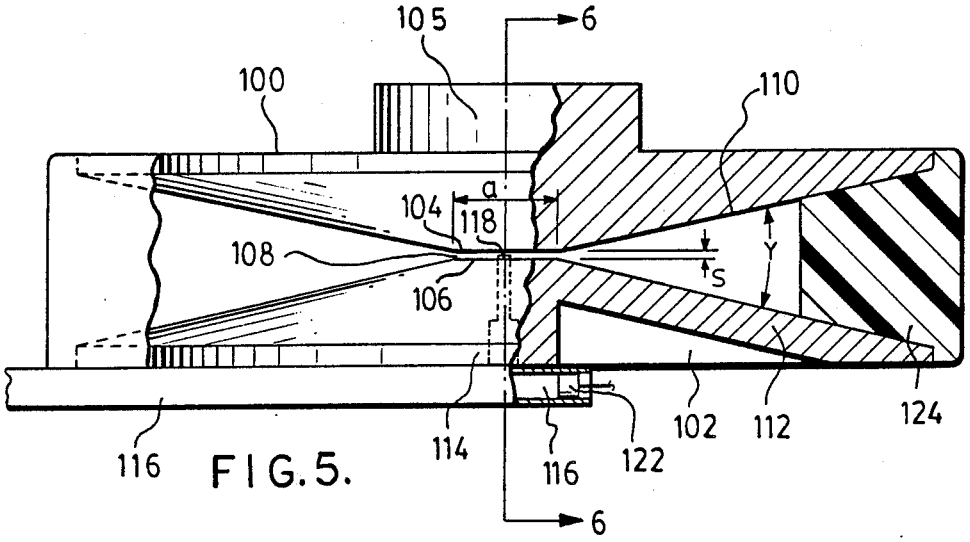
FIG. 5 is a side elevation view partly in section of the node antenna of the present invention.
Figure 6:
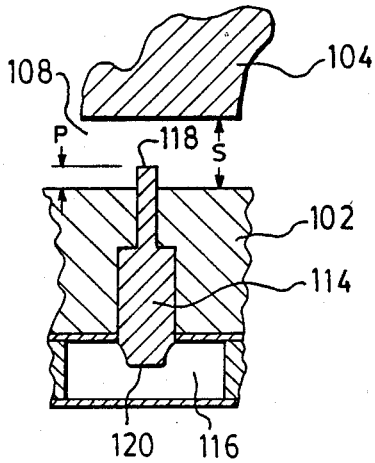
FIG. 6 is a partial schematic section on the line 6 - 6 of FIG. 5 showing the probe (co-axial cable) delivering the signals between the waveguide and the gap.

A preferred form of node antenna 34 is illustrated in FIGS. 4, 5 and 6. This antenna is formed by adapting horn antenna theory and comprises a pair of opposed substantially mirror image frusta-conical disks 100 and 102. These disks 100 and 102 have their conical axes aligned as indicated by the axis 105 and are positioned with their minor axial end surfaces 104 and 106 facing each other in spaced parallel relationship to define a gap 108 therebetween. The width of the gap 108 is indicated by the dimension S and S will be less than ½ a wavelength for the frequency being transmitted and received.

The cone angle will be selected for the particular frequencies being used. For the extra high frequencies in the order of about 60 GHz this included angle will be about 157 degrees so that the included angle Y between the conical surfaces 110 and 112 will be about Y =23 degrees.

A first probe antenna 118 extends into the gap 108 along the conical axis 105 of the disk 102 and is connected by a coaxial cable 114, which in the illustrated arrangement also extends axial of the disk 102, to a second probe antenna 120 positioned in a wave guide 116 . The probe antenna 118 positioned in the gap 108 forms a radially radiating antenna in the presence of the two circular plate boundaries as defined by the flat circular surfaces 104 and 106. The diameter of these surfaces 106 and 108 are the same and are equal to a, which will normally be several wavelengths long. With the specific example of the present invention using the frequencies of about 60 GHz, dimension a=20 mm when the conical disks 100 and 102 have major diameters of 174 mm.

The probe 118 extends into the gap 108 a distance P=about ¼ of a wavelength and the probe 120 projects into the wave guide 116 a similar distance P. The probe 120 radiates energy to and receives energy from the wave guide 116.

The exact dimensions of the probe antennae 118 and 120 and the geometry of the coaxial connecter 114 have to be determined through maximizing the power transfer (by proper impedance match). In the illustration a single step geometry of the coax connecter 114 is shown; in practice zero or multiple stage or tapered matching can be used.

A suitable shorting plunger 122 is provided at the end of the waveguide 116 to maximize the field at the probe 120.

Preferably, the connecter 114 is a coaxial cable suspended within a passage axial of the disk 102 via a low loss dielectric packing.

A suitable annular expanded polystyrene spacer element 124 fits between the two disks 100 and 102 and engages the conical surfaces 110 and 112 relatively position them.

In the omni-directional node antenna 34 described above the energy is transmitted in the TEM mode.

Figure 8:
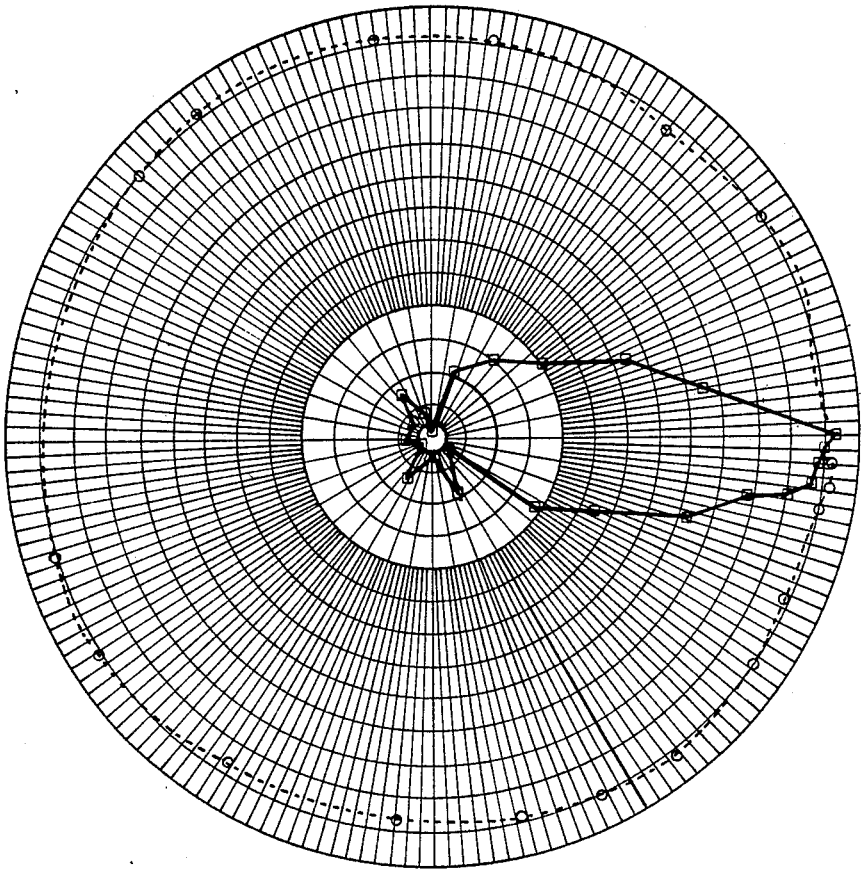
FIG. 8 illustrates the radiation pattern of the omnidirectional antenna illustrated in FIGS. 4, 5 and 6.

The radiation pattern for the omni-directional antenna 34 above described is illustrated in FIG. 8 to a scale of 10 dB/inch with an original set at 48.5 dB. The solid line shows the E-plane radiation and the dashed line, the H-plane.

Figure 7:
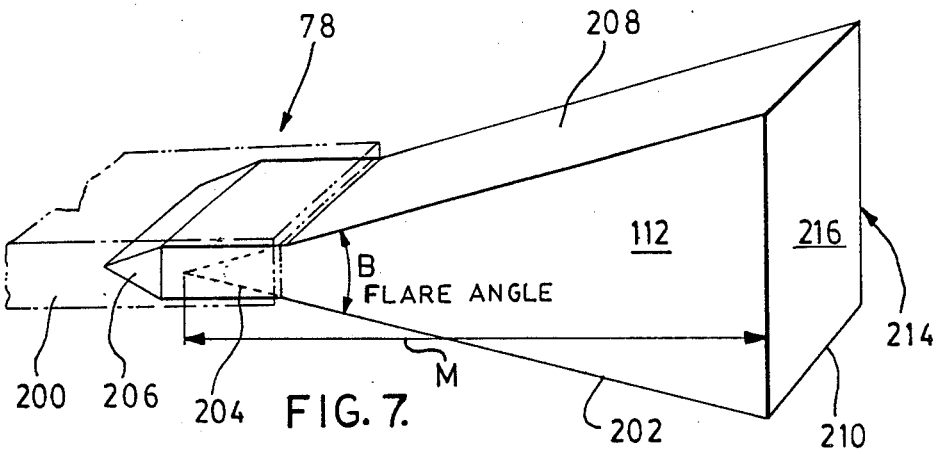
FIG. 7 is a schematic isometric illustration of a preferred type of subscriber antenna which is a special type dielectric rectangular rod antenna.

The preferred form of the subscriber antenna 78 is shown in FIG. 7. A suitable waveguide illustrated in dot/dash lines 200 delivers energy to and from the dielectric rod 202 which may be formed of any suitable dielectric material such as polystyrene. In the arrangement illustrated, the rod element 202 has a tongue section 204 that is received in the open end of the wave guide 200 for a predetermined distance and terminates with a pointed end 206. The major portion of the rod 202 projects from the wave guide 200 and is of substantially rectangular cross section. The opposed broad sides 208 and 210 spread symmetrically laterally as the distance from the waveguide increases at an included angle B. The two narrow sides 212 and 214 are parallel. In the particular example discussed above, the included angle B=about 10 degrees and the length of the tapered portion from the end face 216 to the point of intersection of the projections of the surfaces 208 and 210 as designated by the dimension M=38 mm. The projection 204 extends further from the surface 216 by 4 mm more, before the tapered section 206 commences.

Figure 9:
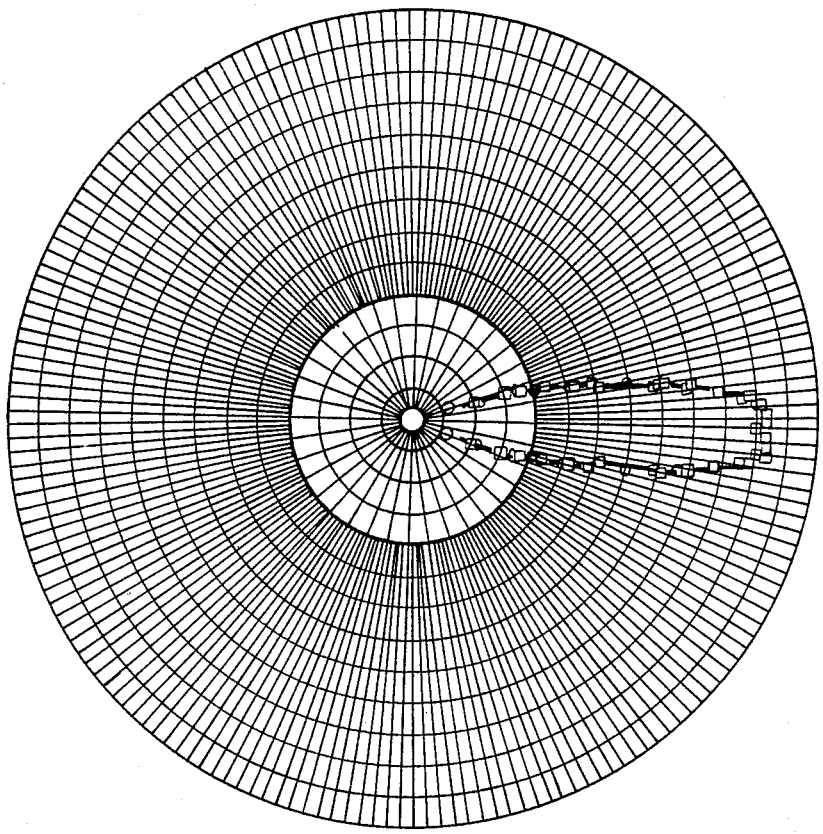
FIG. 9 illustrates the radiation pattern of the antenna illustrated in FIG. 7.

The above described subscriber antenna has a radiation pattern (for the 10 degree E flare) shown in FIG. 9. The scale used is 10 dB/inch, the solid line is the E-plane and the dashed line, the H-plane. The radiation in the E and H planes is about equal.

The above system may be used with a suitable spread spectrum technique if desired.

Having described the invention modifications will be evident to those skilled in the art without departing from the spirit of the invention as defined in the appended claims.

We claim:

1. An intrabuilding wireless multi-access communication system for use within a work space, comprising an omni-directional antenna system transmitting coded signals and supplying radiation substantially only within a first zone occupying only a portion of said work space, a second zone substantially free of radiation and occupying substantially the remainder of said work space, said first zone being positioned adjacent to an upper boundary of said work space, work stations within said second zone, each of said work stations having a subscriber antenna system connected thereto, each said subscriber antenna system having a subscriber antenna positioned within said first zone and oriented relative to said omni-directional antenna to receive signals from said omni-directional antenna and transmit signals to said omni-directional antenna.

2. A communication system as defined in claim 1 wherein said first zone is spaced from a floor of said work space by about 2 meters to provide a radiation free zone substantially equivalent to the height of workers in said work space.

3. A communication system as defined in claim 1 wherein said omni-directional antenna comprises a pair of substantially mirror image frusta-conical disks having their conical axes in axial alignment and with their minor diameter ends in substantially parallel spaced facing relationship and defining a pair of opposite sides of a gap formed therebetween, an axially extending probe antenna extending along said conical axis of one of said disks and located within said gap, a second probe antenna structure located within a waveguide for delivering energy to and from said antenna, and a connecter means connecting said axially extending probe antenna and said second probe antenna whereby energy is carried between said waveguide and said gap.

4. A communication system as defined in claim 1 wherein said subscriber antenna system for each said work station comprises a dielectric rectangular rod antenna including a waveguide and a flared dielectric element extending from said waveguide, said dielectric element having two pairs of opposed planar sides, one of said pairs of opposed sides having sides diverging from each other at an angle symmetric with the longitudinal axis of said waveguide from which said dielectric element extends.

5. A communication system as defined in claim 3 wherein said connecter means comprises a coaxial cable extending along said conical axis of said one of said disks.

6. A communication system as defined in claim 3 wherein the longitudinal axis of said waveguide is transverse to said conical axes.

7. A communication system as defined in claim 4 wherein said angle is substantially equal to 10 degrees.

8. A communication system as defined in claim 4 wherein said one pair of sides is broader than the other pair of two pairs of sides.

* * * * *